United States Patent [19]

Cox, III

[11] 4,404,817

[45] Sep. 20, 1983

[54] SATELLITE ICE PLANT

[76] Inventor: Herman G. Cox, III, P.O. Box 2140, Fort Worth, Tex. 76113

[21] Appl. No.: 352,184

[22] Filed: Feb. 25, 1982

[51] Int. Cl.[3] ..... F25C 5/18

[52] U.S. Cl. ..... 62/320; 62/344; 62/459

[58] Field of Search ..... 62/320, 344, 459, 529; 222/146 C

[56] References Cited

U.S. PATENT DOCUMENTS

| | | | |
|---|---|---|---|
| 3,151,668 | 10/1964 | Zimmermann | 62/344 X |
| 3,277,666 | 10/1966 | Simmons | 62/344 X |
| 3,797,267 | 3/1974 | Hagen | 62/344 X |
| 3,858,765 | 1/1975 | Landers | 222/146 C X |
| 3,913,343 | 10/1975 | Rowland et al. | 62/344 X |
| 3,918,266 | 11/1975 | Gindy et al. | 62/344 X |
| 4,104,889 | 8/1978 | Hoenisch | 62/344 X |
| 4,348,872 | 9/1982 | Hill | 62/459 |
| 4,354,360 | 10/1982 | Fiske | 62/320 |

*Primary Examiner*—William E. Tapolcai
*Attorney, Agent, or Firm*—Wofford, Fails & Zobal

[57] ABSTRACT

A satellite ice plant operable by a single operator bagging ice comprising ice making apparatus; comminution apparatus for reducing the ice to a size for bagging; refrigerated storage housing which is cooled below freezing point of the ice and has a storage bin for storing the ice, conveyor for conveying the ice from the comminution apparatus to the storage bin, freeze-up prevention device disposed in the refrigerated storage housing and operable to prevent freezing up of the conveyor, ice break up apparatus for breaking up the stored ice for bagging, second conveyor interiorly of the refrigerated storage housing for conveying the ice to a bagging machine, and controls operable to automatically effect the operation of the respective elements to supply ice to the bagging machine at the signal of a operator bagging ice. Also disclosed are specific preferred pieces of apparatus for moving the stored ice, breaking it into crushed ice size, snow removal and the like.

8 Claims, 8 Drawing Figures

SATELLITE ICE PLANT

FIELD OF THE INVENTION

This invention relates to ice making and bagging apparatus. More particularly, it relates to automated apparatus for supplying ice for bagging responsive to signals from a single operator and operable at a given site but moveable to a new site should that one not be economically advantageous.

BACKGROUND OF THE INVENTION

The prior art has seen the development of wide range of apparatus for dispensing and selling ice. This has ranged from the early ice houses in which ice was cut from lakes or the like during winter and stored in insulated storage rooms to be sold later; through a variety of types of ice manufacturing and selling apparatuses and processes. Of the current ice manufacturing apparatus, these range from making large, 300 pound blocks of ice in brine at sub-freezing temperatures and thereafter crushing the ice and bagging it; to small ice making means that make the ice by freezing adjacent plates, tubes and the like and thereafter warming the ice bond to free the ice to fall into a storage bin. Ordinarily the central ice making plants for making large blocks of ice are permanent and are frequently antiquated. They are costly to operate and difficult to obtain loans because they cannot be moved once they are built. On the other hand, the small units frequently are unable to manufacture enough ice for a given community or the like. Consequently, there is demand for an intermediate type of ice plant able to produce enough ice for a given community or local, even though it may be less able to produce exceptionally large quantities of ice, as for icing box cars and the like. Such an intermediate ice plant should have the following desirable features:

1. The intermediate ice plant should be mounted on skids or the like so as to be portable and be moved to a new location in the event that the business decisions or predictions for a given local are proven inaccurate.
2. The intermediate ice plant should automatically supply ice to a bagging machine operated by a single operator without requiring a plurality of employees; thereby keeping operational costs low.
3. The intermediate ice plant should be able to deliver ice into a sub-freezing storage bin without having freeze-up of the conveyor conveying the ice into the bin.
4. The intermediate ice plant should be able to move the stored ice into an ice bagging machine in a size suitable for bagging and automatically supply the ice on demand by the operator operating the bagging machine.

As will be apparent from a consideration of the foregoing, the prior art fails to supply these desirable features.

SUMMARY OF THE INVENTION

Accordingly, it is the object of this invention to provide an intermediate size ice plant that has one or more of the foregoing desirable features not heretofore supplied.

It is another object of this invention to provide an intermediate size ice plant that has all of the foregoing desirable features.

These and other objects will be apparent from descriptive matter hereinafter, particularly when taken in conjunction with the appended drawings.

In accordance with this invention there is provided an intermediate sized ice plant operable by a single operator bagging ice and comprising:

a. ice making means for making ice:
b. comminution means for reducing the ice to crushed ice size for bagging;
c. refrigerated storage housing which is cooled below the freezing point of the ice, the refrigerated storage housing having a bin for storing the ice;
d. first conveyor means for conveying the ice to the refrigerated storage housing, the conveyor including at least one screw conveyor having snow removal means disposed at a location therealong for removing snow;
e. freeze-up prevention means disposed in communication with the conveyor means and adapted to prevent freezing up of the conveyor means at its entrance into the refrigerated storage housing;
f. ice break up means for breaking up the stored ice for bagging;
g. second conveyor means interiorly of the refrigerated storage housing for conveying the broken up ice to a bagging machine;
h. control means operable automatically to supply ice, effect breaking up of the ice and convey the broken up ice to an ice bagging means responsive to needs for ice thereat; and
i. ice bagging means, including the ice bagging machine in the refrigerated storage housing adapted for bagging ice responsive to an operator;

such that one operator can operate the ice bagging means and the remainder of ice plant will automatically supply ice therefor.

DESCRIPTION PREFERRED EMBODIMENTS

Figure 1:
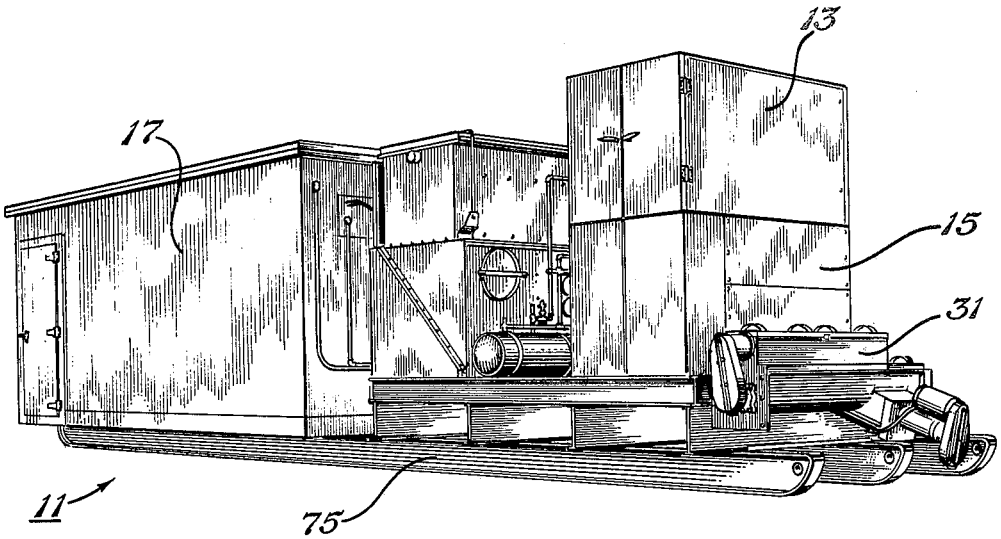
FIG. 1 is a perspective view of one embodiment of this invention.

Referring to FIG. 1, the intermediate ice plant 11 includes an ice making means 13 for freezing the ice; comminution means 15 for reducing the ice to the size of crushed ice for bagging, refrigerated storage housing 17 cooled below the freezing point of the ice for storing the ice and first conveyor means 19, FIG. 2 for conveying the ice from the comminution means to the refrigerated storage housing.

Figure 4:
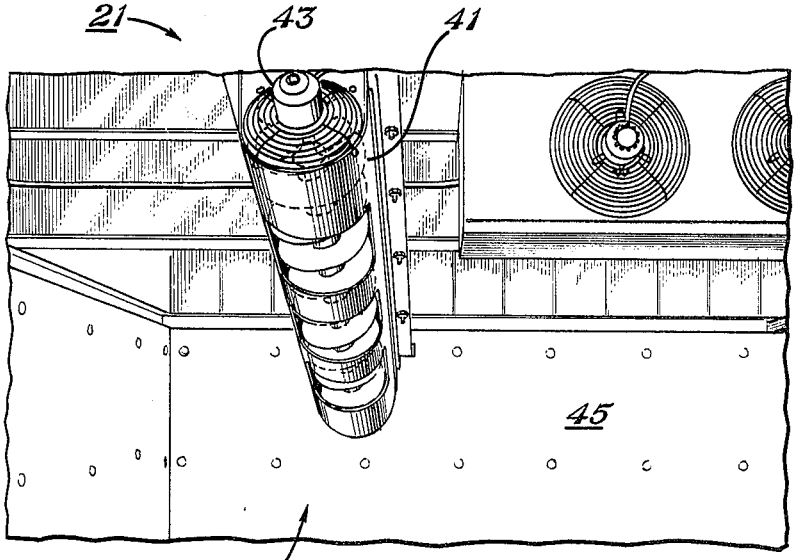
FIG. 4 is a perspective view of the interior end of the conveyor means for dumping ice into the storage bin.

The intermediate size ice plant also includes a freeze-up prevention means 21, FIG. 4 for preventing freeze-up of the conveyor means at its entrance into the refrigerated storage housing 17; ice break up means 23, FIG.

Figure 5:
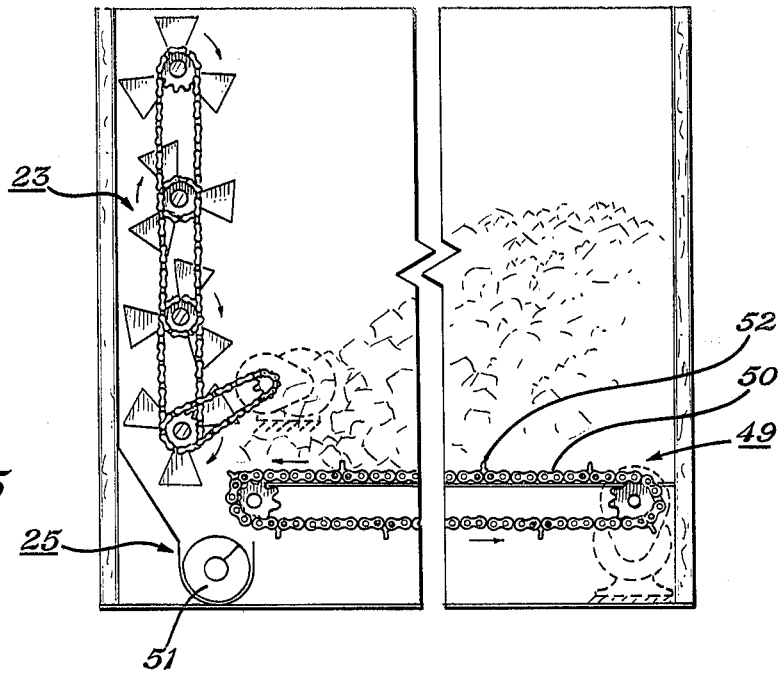
FIG. 5 is a perspective view of the second conveyor means and the ice break up means of FIG. 1.
Figure 7:
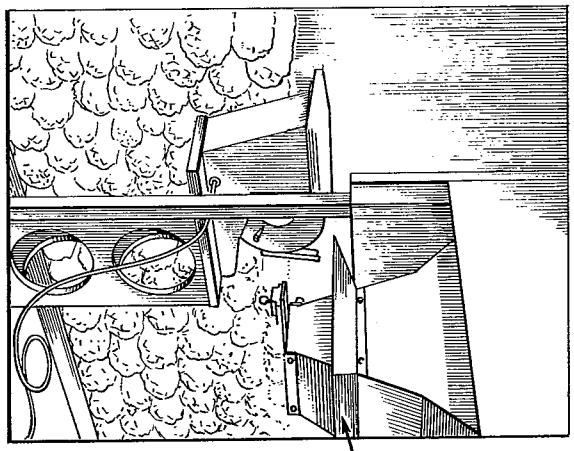
FIG. 7 is a perspective view of the ice bagging machine of FIG. 1.
Figure 6:
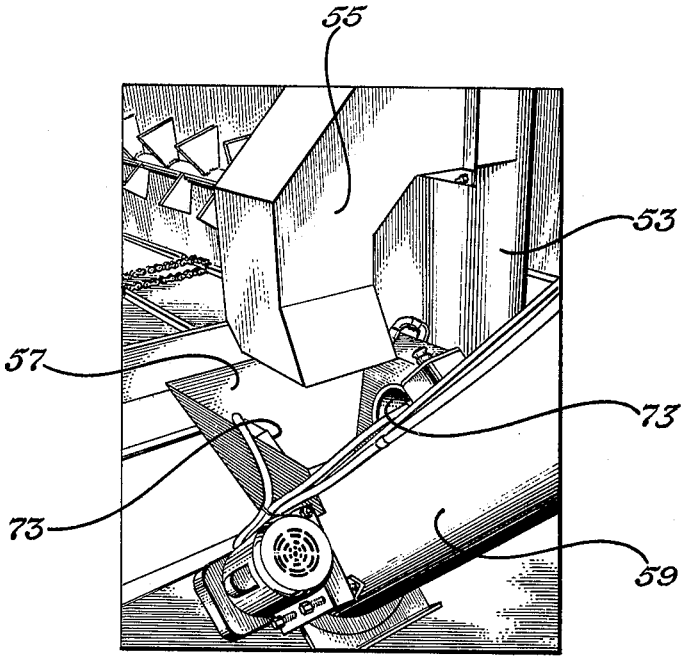
FIG. 6 is a perspective view of the vertical screw conveyor and hopper of the second conveyor means.
Figure 8:
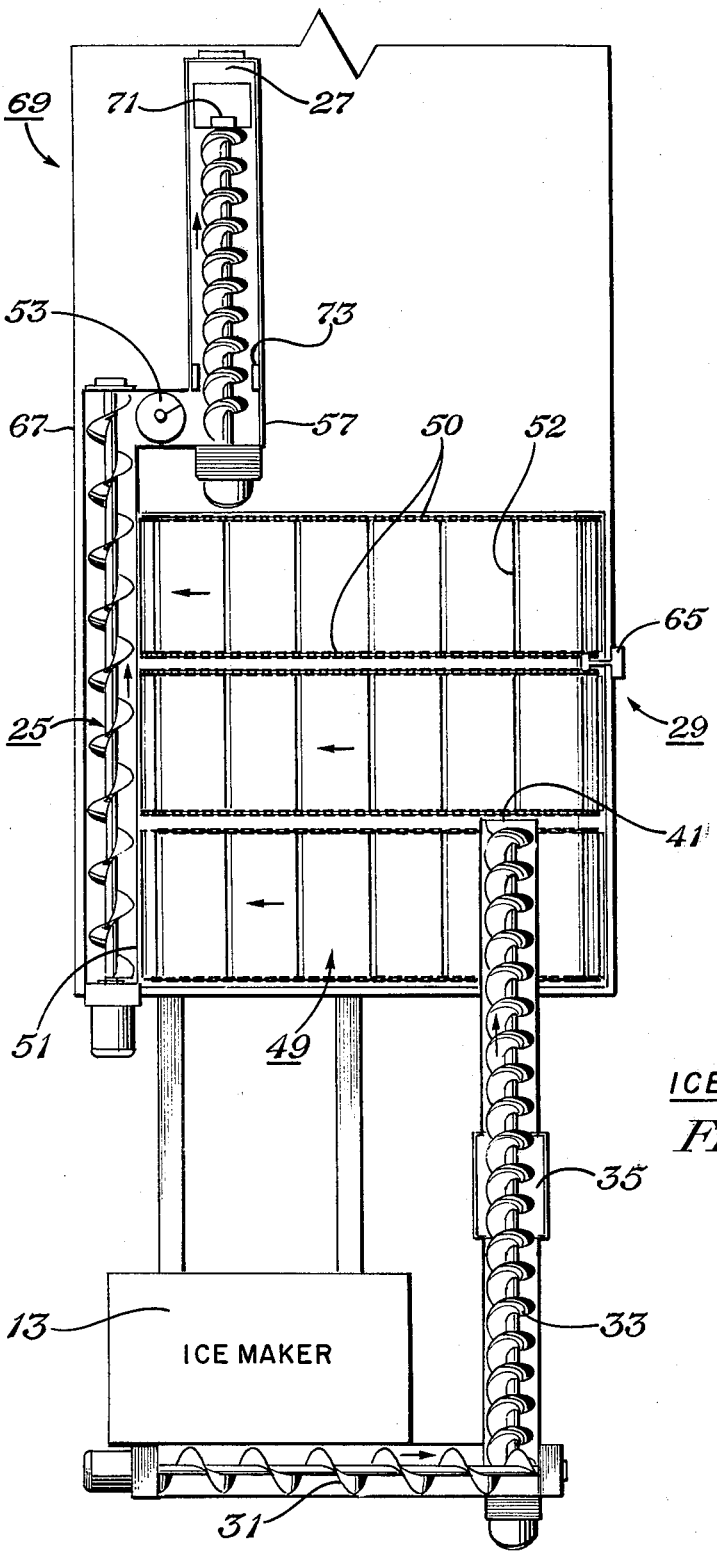
FIG. 8 is a schematic over all view showing placement of the various controls.

5, for breaking up the stored ice for bagging;, second conveyor means 25, FIGS. 5 and 6, for conveying ice interiorly of the refrigerated storage housing to an ice bagging means 27, FIG. 7; and control means 29, FIG. 8, operable to automatically effect breaking up of the ice and supplying the broken up ice to a bagging machine responsive to operations by a single operator bagging ice.

The ice making means 13 may comprise any of the commercially available apparatus for making ice. As is recognized; conventionally, such apparatus includes the conventional compressor and condenser for liquefying the refrigerant flowing in a circuit and thereafter flashing the refrigerant from its liquid form to a vaporized form through evaporator tubes to create a low temperature adjacent a freezing plate, pipes or the like, returning the flashed refrigerant to the suction side of the compressor for recompression and repeating the cycle. Relatively purified water is flowed over the freezing mold such as a plate, tubes or the like to freeze the ice. At such time as the ice is adequately frozen, it is dumped to the comminution means 15.

The ice making means 13 is conventional and is bought from others. For example, in the illustrated embodiment, the Turbo ice machine is employed to make sheet ice that is dumped to the comminution means 15; although any other conventional form commensurate and compatible with the comminution means 15 could be employed in this invention.

The comminution means 15 is a means for breaking the ice into the size suitable for bagging. Ordinarily, size suitable for bagging is on the order of from ½ inch to no larger than 2 inches in mean dimension. Of course different sizes may be employed for different purposes. If desired, suitable screens can be employed to segregate the ice into different sizes for different purposes. In this invention as illustrated, however, the comminuted ice is formed into a single size range that is stored in the refrigerated storage housing 17. Typically, the comminution means 15 may comprise heated grids for breaking plate ice into small squares or rectangles, although it can be large breaker hammers for breaking the sheet ice as it is dropped into hoppers, or rotary drums with teeth for breaking the ice into the desired shape. The type of comminution means is relatively immaterial to this invention, as long as the proper sized ice is supplied to the refrigerated storage housing 17.

The refrigerated storage housing 17 comprises insulated rooms of suitable dimension for the storage bin for the ice as well as for the other elements located interiorly thereof. The refrigerated storage housing 17 is cooled by suitable means such as air being blown over one or more evaporator coils. In the illustrated embodiment of FIG. 1, one evaporator coil is employed for the ice storage bin at the end of the housing 17 adjacent the conveyor means 19 and another evaporator coil is disposed at the opposite end to ensure that the temperature is below the freezing point of the ice even at the ice bagging means 27. Any of the conventionally available refrigeration units employing the evaporator coils can be employed in this invention to keep the temperature below the freezing temperature of the ice supplied by the first conveyor means 19.

The first conveyor means 19 may comprise any of the suitable conveyors for conveying ice from the ice making means and comminution means 13, 15 into the interior of the refrigeration storage housing 17. Preferably, the conveyor means includes means interiorly of insulated chutes for reducing the melting of the ice. As illustrated the conveyor means includes a horizontal screw conveyor 31 that receives the ice from the top and conveys it laterally of the ice plant 11 to the entrance to an inclined screw conveyor 33, FIG. 2. The housings for the screw conveyors are insulated to reduce melting of the ice. The inclined screw conveyor 33 has a snow removal location 35. The snow removal location 35 comprises an insulated trap door that can be opened to allow access to the interior in conjunction with a foraminous bottom. As illustrated, the foraminous bottom comprises perforated metal in the bottom of the housing adjacent the screw conveyor. The perforations, or slots, allow snow and molten snow to fall downwardly therethrough into a drain 37. The inclined screw conveyor 33 receives the comminuted ice at its bottom end 39 and conveys the ice to its top end 41 interiorly of the refrigerated storage housing 17. The interior end 41 can be seen in FIG. 4. One of the problems of the inventors early attempts to perfect this invention was the freezing up of the conveyor means because the interior end 41 had snow and molten snow brought interiorly of the refrigerated storage housing.

Accordlingly, this invention employs a freezer prevention means 21 to prevent this freeze-up. Specifically, the freeze-up prevention means 21 comprises a fan 43 that pulls the sub-freezing air at least 2 feet downwardly of the inclined screw conveyor. This moves the condensation point back down the inclined screw conveyor toward the snow removal location and prevents condensation and freezing inside the ice bin. If desired a motorized fan 43 interiorly of the refrigerated storage housing can blow the sub-freezing air down the inclined screw conveyor. The ice that is dumped into the bin 45 may agglomerate through fusion but does not refreeze into difficultly broken solid masses of ice.

The ice breakup means 23 comprises a plurality of agitator bars, or beaters 47 mounted above the second conveyor means 25 for breaking off the easily broken ice for falling into the second conveyor after the ice is moved toward the ice break up means 23 by an ice moving means 49.

Specifically, the bin 45 has its walls and bottom formed of a smooth plastic such as high density polyethylene plastic. The plastic is very slick and the ice does not have a tendency to stick to it or to freeze to it. The ice moving means uses three pairs of floor chains 50, FIG. 8, with pusher bars 52 attached to convey the total volume of ice forward into the three break up means in the form of three agitator bars that rotate the beaters 47 responsive to rotation by electric motor. While more or fewer pairs of chains other than three could be employed if desired, the three have been found adequate. This causes the longitudinally extending pusher bars which are connected to the chains to move laterally moving the whole mass of ice toward the beaters 47. The chains are disposed over and in engagement with one or more idler sprockets and one or more power sprockets to be moved by electric motors while moving the ice. The chains and pusher bars may be formed of any material that is adequately strong. It has been found preferable to employ metal such as steel, aluminum or the like to have adequate strength.

The second conveyor means 25 includes a horizontal screw conveyor 51 that has a vertical screw conveyor 53, FIG. 6 adjacent its discharge end. The vertical screw conveyor discharges into chute 55 which, in turn discharges into hopper 57. The hopper 57 accumulates ice for a second inclined screw conveyor 59 that discharges into the ice bagging machine 27, FIG. 7. Since the respective conveyors and their housing are located interiorally of the refrigerated housing 17, it is not necessary to insulate them.

At the ice bagging means 27, the operator can operate in either the automatic or semi-automatic mode to fill the bags and remove the filled bags from the bagging machine 27. The operator seals and stores the bags filled with the ice. Of course, as ice is used, the level of ice falls in the ice bagging means 27. This is the basis for the automated control means 29.

The control means 29 includes a bin level control 65 disposed so as to be responsive to a predetermined level of the ice in the bin 45, an ice movement control 67 disposed so as to be responsive of the level of ice in the horizontal portion of the second conveyor means, 25, and an ice bagging means control 69 disposed so as to be responsive to the level of ice in the ice bagging means 27.

The bin level control 65 may comprise any means such as an arm that is actuated into a raised position as the ice cascades from the end 41 of the screw conveyor 33, FIG. 8. On the other hand, if desired, electric eye type controls can be employed to sense the level of the ice. In any event, the bin level control is operatively connected so as to deenergize the ice making means when there is adequate ice and to energize the ice making means when there is inadequate ice. The degree of adequacy of the ice is shown by a predetermined level at which the bin level control 65 is set.

The ice moving controller 67 comprises a means for sensing when the horizontal conveyor portion of the second conveyor 25 is full of ice. As illustrated, it is an electric eye type control where the ice interrupts the ray of light being sensed by an electric eye when the conveyor is full. This stops the movement of the chains 50 and pusher bars 52 to stop movement of the ice towards the breakers 47 of the ice break up means 23.

The ice bagging control means 69 comprises means for determining when the level is adequate in the ice bagging means 27 and in the hopper 57. As illustrated, they are pressure sensitive switches 71, 73 at respectively, the ice bagger means 27 and the hopper 57 for sensing when ice builds up at these locations.

The refrigerated storage housing 17 has adequate room for storing bags of crushed ice as they are filled and tied by the operator for later dispensing.

In operation, the immediate ice plant is turned on and the operator begins to bag ice at the ice bagging means 27. The ice making means 13 begins operating, circulating water over the cold freezing mold cooled by vaporizing liquid refrigerant in accordance with conventional practice.

The ice when it is made, is discharged into the comminution means 15 where it is broken up into appropriately sized particles. The comminuted ice is dropped into the 9 inch diameter galvanized horizontal screw conveyor 31 which conveys it approximately five feet to the receiving end of the inclined screw conveyor 33. The inclined screw conveyor is also a 9 inch diameter conveyor inside an insulated housing. Midway between the entry point on the inclined conveyor 33 and discharging end 41 of the conveyor, there is located a snow removal section 35 which consists of the indicated metal that is perforated, or has slots, in lieu of a solid trough bottom. Agitator bars or paddles are installed in the screw conveyor at this point to make the ice turn over or revolve when it passes over the perforated metal. This turning action results in the snow falling through three-eighths inch perforations or slots and into a snow box mounted below which uses the defrost water from the ice machine to melt all the snow dropping into it. As is recognized, a defrost liquid, such as defrost water is employed to release the ice from the freezing mold in many commercial machines.

In other machines, hot refrigerant is sent to melt the ice from the freezing mold.

In any event, the snow-free ice continues up the inclined screw conveyor 33 and is dropped into the automated ice storage bin 45. This automated storage bin is the key to the success of this invention. It hold approximately 8,000 pounds of fragmentary ice and the sides and floor material are, as indicated hereinbefore, smooth such that the ice does not have a tendency to stick or freeze to it. The ice moving means 49 comprising the three pairs of floor chains with the pusher bars 52 connected thereto convey the stored ice towards the ice break-up means 23 in the form of three rotary beater bars having beaters 47 which break up the ice into small bagging sizes. The ice falls into the screw conveyor making up the horizontal portion of the second conveyor means 25. The horizontal screw conveyor conveys the ice towards a vertical screw conveyor 53 at the front corner of the bin. The electric eye 67 cuts off the agitator bars 47 and the floor chain 50 when the horizontal screw conveyor fills with ice. Once the horizontal screw has emptied its load into the vertical screw 53 and the ice level falls, the electric eye 67 resets and again starts the agitator bars 47 and comprising the ice break-up means 23 and the chains 50 and pusher bars 52 of the ice moving means 49.

After the ice travels through the horizontal and then up the vertical screw conveyors 51, 53, it is dropped into the hopper of the ice bagger, or ice bagging means 27. The ice bagger has two pressure sensitive switches installed in the hopper area, indicated by 73, which senses the pressure from any of the ice that accumulates and cuts off the vertical and horizontal screw conveyors 51, 53. Immediately beneath the hopper 57 is an inclined, 9 inch screw conveyor 59 which delivers ice to the ice bagging means 27. Again there is a pressure sensitive switch installed at the juncture of the inclined screw conveyor 59 and the ice bagging means 27 which cuts off the inclined conveyor when the ice bagging machine is full of ice. The operator controls the function of the ice bagging means 27 and hence indirectly through the automatic controls, the ice maker storage bin moving means, break-up means and the like.

In a standard sequence of events, the operator would turn on the bagger and check for proper operation; turn on the vertical and horizontal screw conveyors 51, 53 of the ice storage bin which are controlled by one common switch. Any ice that has flowed into the horizontal during the filling process is evacuated at this time. The operator then turns on the agitator bar 47 and floor chain 50 switch to check that these motors operate. If the ice has not been evacuated from the horizontal screw, however, these motors will come on at an appropriate time when the conveyor load is reduced sufficiently in order for the electric eye 67 to make contact.

As the ice in the ice storage bin 45 moves toward the agitator bar, or ice break-up means 23, a void is created at the back wall of the ice. This enables the ice machine to start back into production, again filling the void. The entire ice storage facility is kept at about 20° F. to reduce any propensity toward melting and re-freezing.

Figure 2:
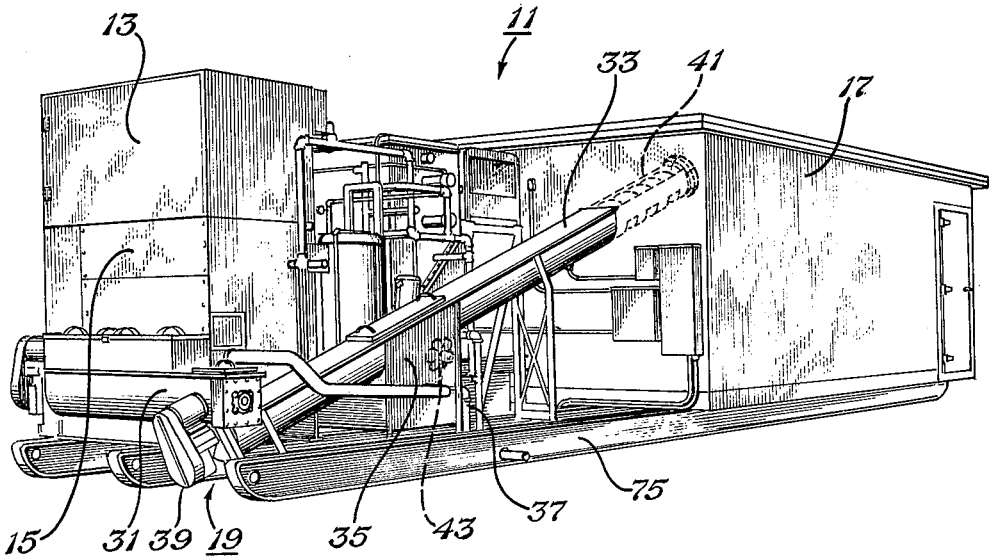
FIG. 2 is a perspective view of the other side of the embodiment of FIG. 1.
Figure 3:
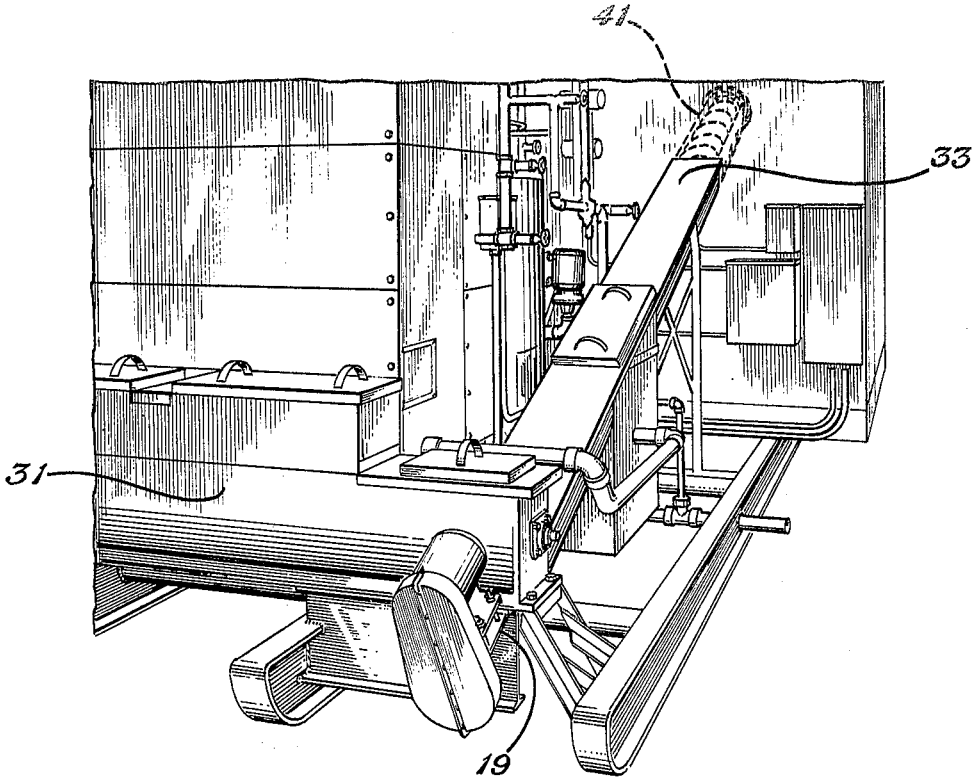
FIG. 3 is a perspective view of the first conveyor means of FIG. 1.

In this invention, all of the elements are mounted on skids 75, FIGS. 1 and 2 such that the intermediate ice plant 11 can readily moved to a different location in the event that it is found economically advantageous to do so. This facilitates bank loans since no permanent real estate investment is involved and since the security is much more valuable to the bank than a permanent ice plant installation.

From the foregoing, it can be seen that this invention achieves the objects delineated herein before. Specifically, this invention provides an intermediate sized ice plant having its own ice making means, comminution means and that can be operated by a single operator; automatically supplying ice as the operator bags the comminuted ice for subsequent sale.

Although this invention has been described with a certain degree of particularity, it is understood that the present disclosure is made only by way of example and that numerous changes in the details of construction and the combination and arrangement of parts may be resorted to without departing from the spirit and the scope of the invention, reference for the latter purpose being had to the appended claims.

What is claimed is:

1. A satellite ice plant operable by a single operator bagging ice, comprising:

a. ice making means for freezing ice;

b. comminution means for reducing the ice to crushed ice size for bagging; said comminution means disposed so as to take the ice from the ice making means;

c. refrigerated storage housing which is cooled below the freezing point of said ice, said refrigerated storage housing having a bin for storing said ice;

d. conveyor means for conveying said ice to said refrigerated storage housing; said conveyor means including at least one screw conveyor having a snow remover means disposed at a location therealong for removing snow;

e. freeze-up prevention means for preventing freeze-up at the entrance of said conveyor means into said refrigerated storage housing; said freeze-up prevention means being disposed in communication with said conveyor means and adapted to prevent freeze-up of said conveyor means at its entrance into said refrigerated storage housing;

f. ice break up means for breaking up stored said ice for bagging;

g. second conveyor means interiorly of said refrigerated storage housing for conveying the ice that has been broken up to a bagging means;

h. control means operable automatically to supply said ice, breaking up of stored said ice, and convey the broken up ice to a bagging means responsive to need for ice thereat;

i. ice bagging means in said refrigerated storage housing and adapted to bag ice responsive to an operator;

such that one operator can operate said ice bagging means and the remainder of said satellite ice plant would automatically supply ice therefor said freeze-up prevention means comprising a means for subjecting the first end of said conveyor means to sub-freezing temperatures such that ice emerging interiorly of said bin is frozen and no water is carried interiorly of said bin to freeze up said conveyor means.

2. The satellite ice plant of claim 1 wherein said conveyor means includes an inclined screw conveyor terminating at its first end interiorly of said bin and said refrigerated storage housing and receiving the comminuted ice at its second and other end and having said snow removal means intermediate said ends, said snow removal means including apertures adjacent the bottom of said inclined conveyor trough through which snow and molten snow can fall into a drain.

3. The satellite ice plant of claim 1 wherein said satellite ice plant is mounted on a skid and is portable so it can be moved by simply loading the skid onto a carrier and disposing it at a new location.

4. The satellite ice plant of claim 1 wherein said means for subjecting said first end of sub-freezing temperature comprises a blower that pulls cold air downwardly into said first end for a distance of at least two feet.

5. A satellite ice plant operable by a single operator bagging ice, comprising:

a. ice making means for freezing ice;

b. comminution means for reducing the ice to crushed ice size for bagging; said comminution means disposed so as to take the ice from the ice making means;

c. refrigerated storage housing which is cooled below the freezing point of said ice, said refrigerated storage housing having a bin for storing said ice;

d. conveyor means for conveying said ice to said refrigerated storage housing; said conveyor means including at least one screw conveyor having a snow remover means disposed at a location therealong for removing snow;

e. freeze-up prevention means for preventing freeze-up at the entrance of said conveyor means into said refrigerated storage housing; said freeze-up prevention means being disposed in communication with said conveyor means and adapted to prevent freeze-up of said conveyor means at its entrance into said refrigerated storage housing;

f. ice break up means for breaking up stored said ice for bagging;

g. second conveyor means interiorly of said refrigerated storage housing for conveying the ice that has been broken up to a bagging means;

h. control means operable automatically to supply said ice, breaking up of stored said ice, and convey the broken up ice to a bagging means responsive to need for ice thereat;

i. ice bagging means in said refrigerated storage housing and adapted to bag ice responsive to an operator;

such that one operator can operate said ice bagging means and the remainder of said satellite ice plant would automatically supply ice therefor; said bin having smooth walls that resist adhesion of and freezing connection with said ice, having a breakup means above at least a portion of said second conveyor means for breaking up said ice that is moved towards said second conveyor means and having an ice moving means for moving said ice towards said second conveyor means.

6. The satellite ice plant of claim 5 wherein said ice moving means comprises a plurality of continuous chains traversing over power sprocket and idler sprockets laterally of said bin towards said second conveyor means, motor means for powering said power sprockets and hence said chains when energized, and longitudinally extending pusher bar means connected respectively with respective said chains so as to move said ice towards second conveyor when said chains are moved.

7. A satellite ice plant operable by a single operator bagging ice, comprising:

a. ice making means for freezing ice;

b. comminution means for reducing the ice to crushed ice size for bagging; said comminution means disposed so as to take the ice from the ice making means;

c. refrigerated storage housing which is cooled below the freezing point of said ice, said refrigerated storage housing having a bin for storing said ice;

d. conveyor means for conveying said ice to said refrigerated storage housing; said conveyor means including at least one screw conveyor having a snow remover means disposed at a location therealong for removing snow;

e. freeze-up prevention means for preventing freeze-up at the entrance of said conveyor means into said refrigerated storage housing; said freeze-up prevention means being disposed in communication with said conveyor means and adapted to prevent freeze-up of said conveyor means at its entrance into said refrigerated storage housing;

f. ice break up means for breaking up stored said ice for bagging;

g. second conveyor means interiorly of said refrigerated storage housing for conveying the ice that has been broken up to a bagging means;

h. control means operable automatically to supply said ice, breaking up of stored said ice, and convey the broken up ice to a bagging means responsive to need for ice thereat;

i. ice bagging means in said refrigerated storage housing and adapted to bag ice responsive to an operator;

such that one operator can operate said ice bagging means and the remainder of said satellite ice plant would automatically supply ice therefor; said control means including:

j. a bin level control so as to be responsive to the level of ice in said bin and energize when said ice is below a pre-determined level indicating inadequate ice and de-energized when said ice is above said pre-determined level indicating adequate ice;

k. ice movement control disposed so as to be responsive to the level of ice in a horizontal portion of said second conveyor means and to de-energize said ice moving means when there is adequate ice and to energize said ice moving means when there is inadequate ice; and l. an ice bagging means control disposed so as to be responsive to the level of ice in said ice bagging means and to de-energize said second conveyor when said ice bagging means has adequate ice and to energize said second conveyor means when said ice bagging means has inadequate ice.

8. The satellite ice plant of claim 7 wherein said second conveyor means includes:

a. a horizontal screw conveyor disposed beneath said ice break up means for receiving the broken ice and conveying it toward the discharge end of said horizontal screw conveyor;

b. a vertical screw conveyor communicating with said horizontal screw conveyor at its discharge end so as to take said ice and raise it vertically into a hopper;

c. a hopper disposed beneath the discharge end of said vertical screw conveyor; and d. an inclined screw conveyor having its receiving end disposed beneath said hopper and its discharge end above said ice bagging means so as to discharge ice thereinto;

said ice movement control means comprises an electric eye control for sensing when said horizontal screw conveyor is filled with said ice; said ice bagging means control includes pressure sensitive switches for sensing when ice is present to a pre-determined level in said ice bagging machine and to a pre-determined level in said hopper.

* * * * *